United States Patent [19]

Talley

[11] 4,358,994

[45] Nov. 16, 1982

[54] CAN FLATTENER

[76] Inventor: John D. Talley, 1817 Dodge Trail, Grand Prairie, Tex. 75052

[21] Appl. No.: 213,344

[22] Filed: Dec. 5, 1980

[51] Int. Cl.[3] ..... B30B 9/32

[52] U.S. Cl. ..... 100/45; 100/49; 100/53; 100/99; 100/137; 100/215; 100/257; 100/295; 100/902

[58] Field of Search ..... 100/902, 49, 215, 53, 100/99, 45, 917, 257, 137, 295

[56] References Cited

U.S. PATENT DOCUMENTS

| | | | |
|---|---|---|---|
| 1,248,753 | 12/1917 | Thompson | 100/99 UX |
| 2,619,150 | 11/1952 | Smith | 100/902 |
| 2,707,503 | 5/1955 | Johnson et al. | 100/917 |
| 3,024,720 | 3/1962 | Welsh | 100/902 |
| 3,062,130 | 11/1962 | Huber | 100/902 |
| 3,659,520 | 5/1972 | Garrett et al. | 100/902 |
| 3,732,804 | 5/1973 | Moller | 100/902 |

FOREIGN PATENT DOCUMENTS

| | | | |
|---|---|---|---|
| 2011302 | 7/1979 | United Kingdom | 100/902 |

*Primary Examiner*—Billy J. Wilhite
*Attorney, Agent, or Firm*—Frank P. Cyr

[57] ABSTRACT

An apparatus to flatten a container such as a can employed in the soft drink or beer industry. The apparatus is so designed so as to initially bend the can in half and following the bending of the can in half, the can is then flattened or compressed so as to present a relatively thin laminate. The apparatus is designed to operate in a timed sequence of operation of thus effect the bending of the can and subsequently flatten the same.

5 Claims, 13 Drawing Figures

CAN FLATTENER

BACKGROUND OF THE INVENTION

Within the past several years the use of aluminum cans has greatly increased, particularly in the fields of canned soft drinks and beer. Needless to say, the employment of aluminum in the manufacture of these cans has met with considerable success and the employment of aluminum in the manufacture of the cans instead of the cans heretofore made of steel or like relatively stiff metal has enabled the manufacturer of the cans to provide an easy opening tab at one end thereof which may be easily manipulated to form an opening in the can. Also, for shipping purposes, an aluminum can is much lighter than a like can constructed of sheet steel or like metal. However, the employment of aluminum in the manufacture of the cans has increased the costs in the manufacture of such cans due to the higher costs of aluminum as compared to sheet steel or the like.

With the above in mind, it is one of the objects of the invention to provide a simple yet efficient device to automatically flatten a can and to direct such flattened can to a suitable receptacle where it may be retrieved and sent to a suitable plant or to the can manufacturer for recycling.

Another object of the invention is to provide an apparatus to flatten cans wherein are employed suitable electrical switches and timing mechanisms to initially bend the can in half during one cycle of operation of the apparatus and in a second cycle of operation, the previously bent can is then flattened to thus reduce the size of the can thus enabling the flattened cans to be easily handled when shipped to a recycling center for recovery of the aluminum.

Another object of the invention is to provide an apparatus for flattening cans including a cabinet for the working parts of the apparatus and providing such cabinet with a removable lid which will permit for the operation of the components within the housing only when the lid is in proper position on the cabinet.

Another object of the invention is to provide a can flattener which will effectively flatten cans to a minimum volume, which will occupy a small amount of space in an establishment which can be operated safely by anyone and which is rugged and relatively low in cost to operate.

Another object of the invention is to provide a can flattener which will flatten cans one by one and deposit the flattened can into a suitable receptacle. The flattener is capable of flattening a single can or a multiplicity of cans and when all of the cans have been flattened, the flattener will stop automatically.

Another object of the invention is to provide an inexpensive aluminum can flattener which could be widely marketed and utilized by various business establishments as well as individuals to flatten cans for subsequent compact shipment to a recycling establishment for recovery of the aluminum.

Another object of the invention in accordance with the immediately preceding objects, is to provide a can flattener which may be of simple construction and easy to use so as to provide an apparatus that will be economically feasible, long lasting and relatively trouble free in operation.

Other objects will appear as the description proceeds when taken in connection with the accompanying drawings.

DESCRIPTION OF THE PREFERRED EMBODIMENT

Figure 1:
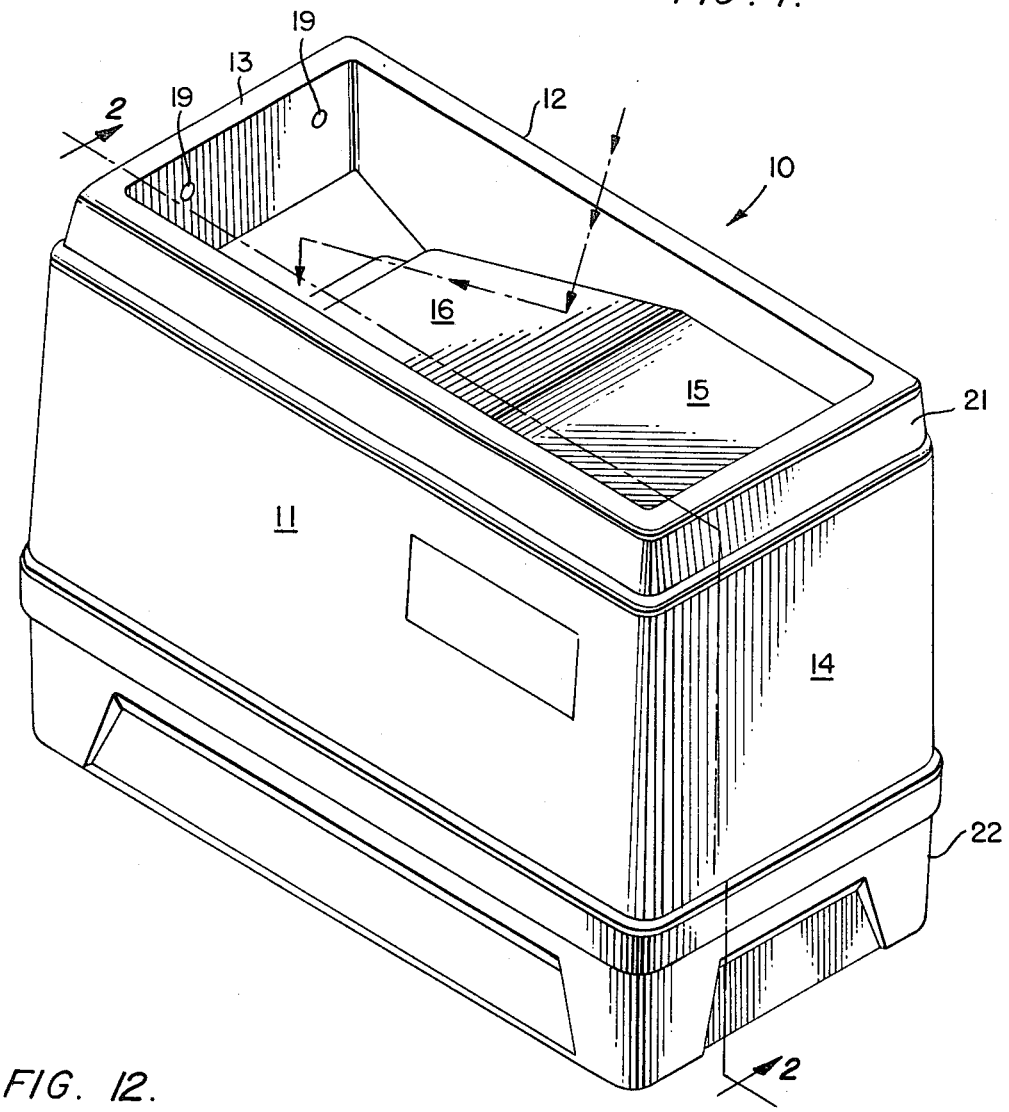
FIG. 1 is a perspective view of the can flattener of the present invention.
Figure 12:
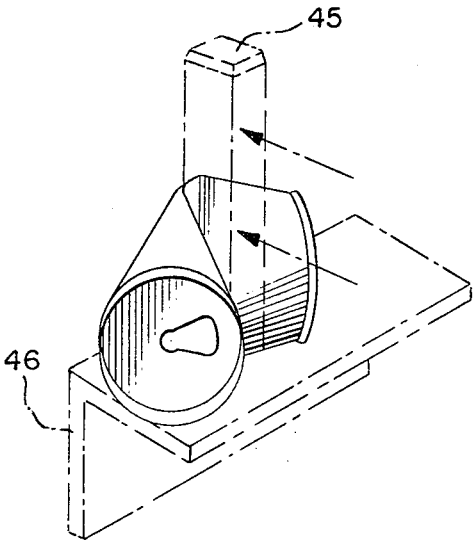
FIG. 12 is a view showing the can having been bent in half.
Figure 13:
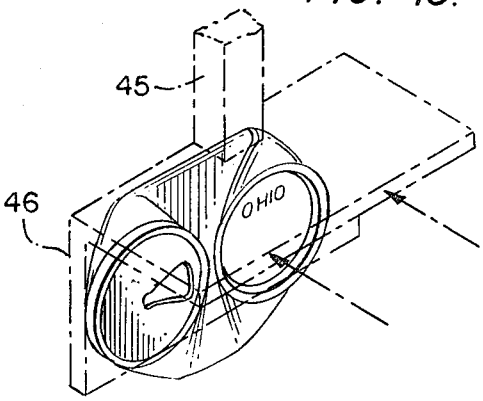
FIG. 13 is a view showing the can when flattened.

Before undertaking a detailed description of the apparatus shown in the accompanying drawings, it must be pointed out that while the apparatus will be described in terms of a can flattener, it is obvious the apparatus can be as effectively employed in flattening other articles where it is desired to flatten the same.

Also, in recent years some states have enacted legislation requiring aluminum containers employed in the beer and soft drink industry be recycled. Where such legislation is in effect, the can manufacturer will print on one end of the can the name of the state where such can is to be used. Where recycling of the aluminum can is mandatory, the manufacturer imposes a deposit for each can and this deposit can only be redeemed by a return of the can to the manufacturer. Thus, with the can flattened instead of being crushed, the can end will display the name of the state for which the can is intended.

Referring now to the drawings wherein like reference numerals are employed to designate like parts throughout the several views numeral 10 designates a cabinet constructed of metal, plastic or the like. The cabinet has front and rear walls 11, 12 and side walls 13, 14. A cover plate 15 is secured in any known manner to the front and rear walls as well as to side wall 14 and terminates in a slanted portion 16 which leads to a drop or chute outlet 16' for the cans. A removable lid 17, FIG. 2, extends over the drop outlet 16' and is provided with a pair of contact members 18, only one shown in FIG. 2 of the drawings. The contact members are adapted to extend through openings 19 formed in a downwardly extending portion of the side wall 13 and will engage with a switch arm 20 for a purpose to be described more fully hereinafter.

Figure 2:
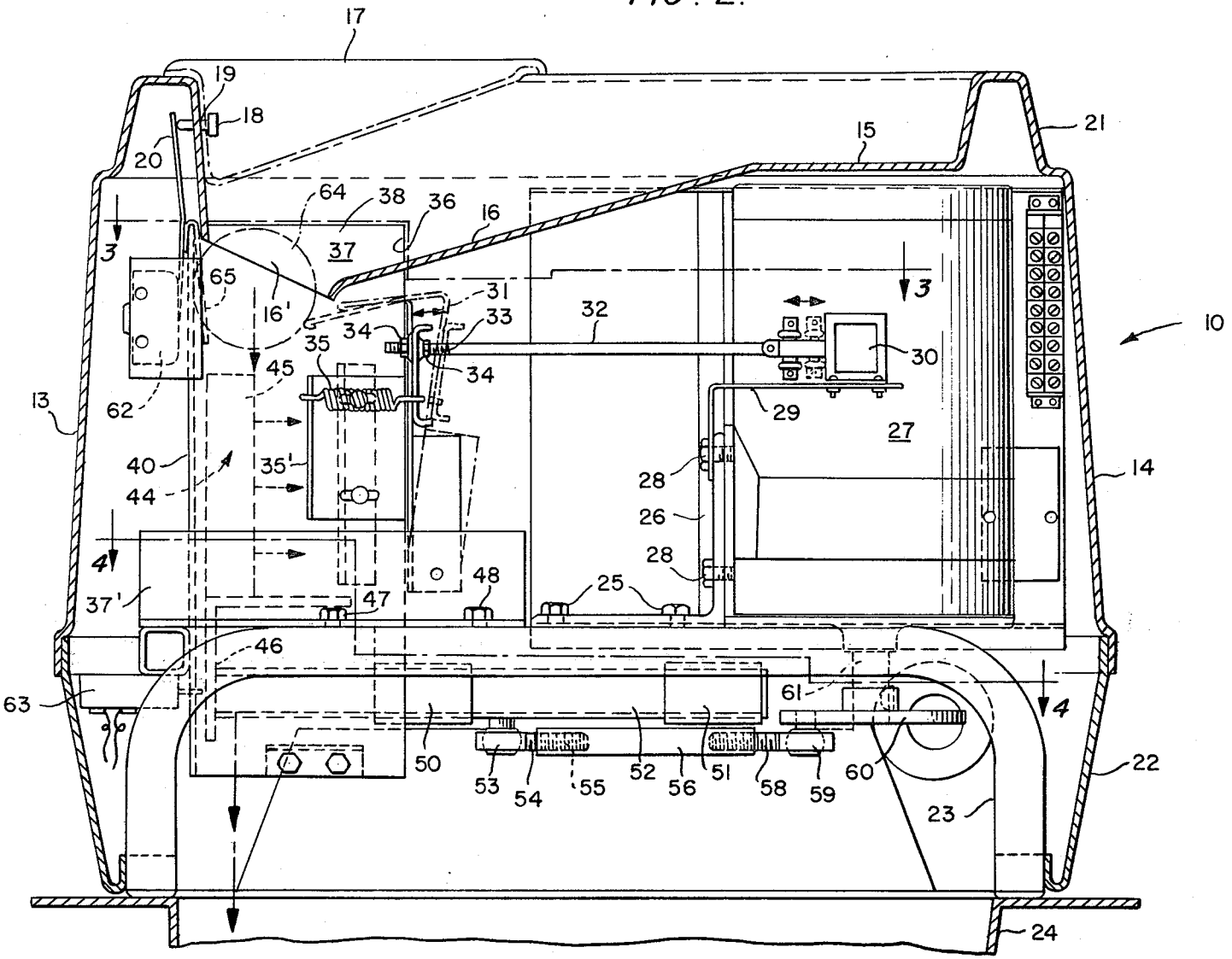
FIG. 2 is a section taken on line 2—2 of FIG. 1, looking in the direction of the arrows.

As shown more particularly in FIG. 2 of the drawings, the cabinet 10 may be formed with an upper portion 21 which frictionally engages with a lower portion 22 to thereby enable the upper portion of the cabinet to be removed from the lower portion to render accessible the working parts of the flattener for service or otherwise for repair or replacement of the working parts of the flattener.

A pair of generally U-shaped leg members 23 only one shown in FIG. 2 of the drawings, are arranged in spaced apart parallel relationship and function to support the flattener on a supporting surface such as an open-ended container 24 which will receive the flattened cans. Mounted on leg members 23 and secured thereto as by bolts 25 is a bracket 26 to which the electric motor 27 is secured in any known manner. Also secured to the bracket 26 as by bolts 28 is a bracket 29 on which is mounted a solenoid assembly 30 designed to operate a gate assembly 31 in a manner to be described more fully hereinafter.

Figure 3:
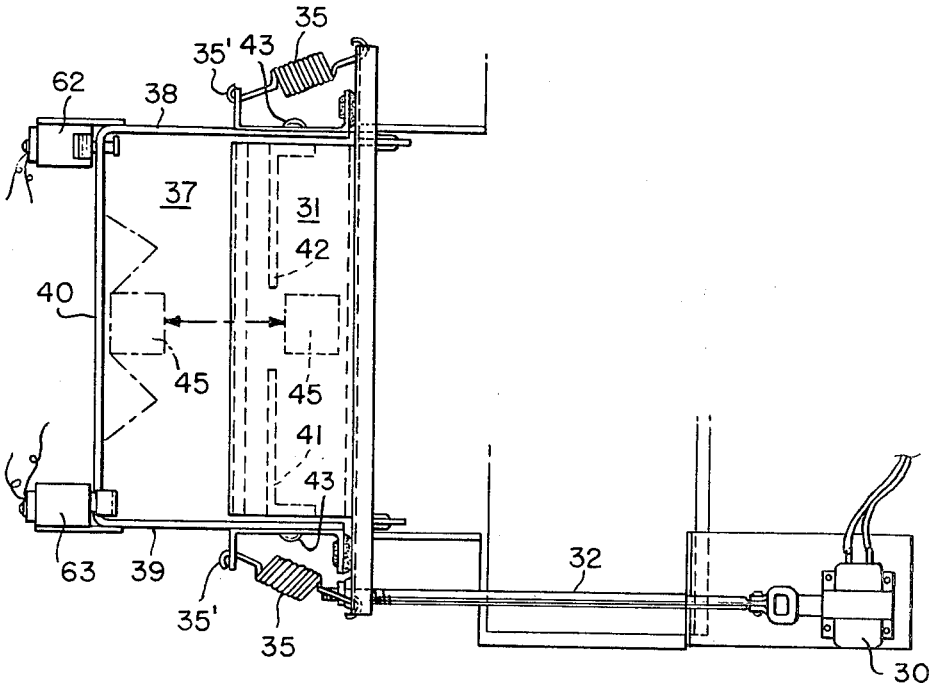
FIG. 3 is a section taken on lines 3—3 of FIG. 2, looking in the direction of the arrows.

A rod 32 extends from the solenoid 30 and is adjustably secured to the aforementioned gate assembly 31 by means of the externally threaded section 33 and nuts 34. The gate assembly 31 is normally held in a closed position by means of springs 35 which extend between the gate assembly 31 and a bracket 35' secured in any known manner to the wall 36 of a chamber assembly shown generally at 37. Chamber 37, see FIG. 3, comprises a generally square formation having side walls 38, 39 and rear wall 40. The front of the chamber includes a pair of spaced-apart sections 41, 42 which are secured in any known manner as by bolts 43 to the side walls 38, 39 of the chamber 37.

The spaced-apart sections 41, 42 will serve to release any bent can from the can bender should the same be stuck on the bender on its rearward travel following the bending operation and this will be described more fully hereinafter.

Brackets 37' one for each side wall 38, 39, are secured to the side walls and are secured to the U-shaped legs 23 as by bolts extending through the brackets 37' and the aforesaid U-shaped legs to secure the chamber 37 thereto.

Mounted for travel between the spaced-apart wall sections 41, 42 is a folder assembly 44. Folder assembly 44 comprises a vertically extending post-like member 45 welded or otherwise secured centrally of a flattener 46. Both the post-like member 45 and flattener 46 are designed to travel to and fro in the manner indicated by the arrows in FIGS. 3 and 4 during operation of the flattener in a manner to be described more fully hereinafter.

Figure 4:
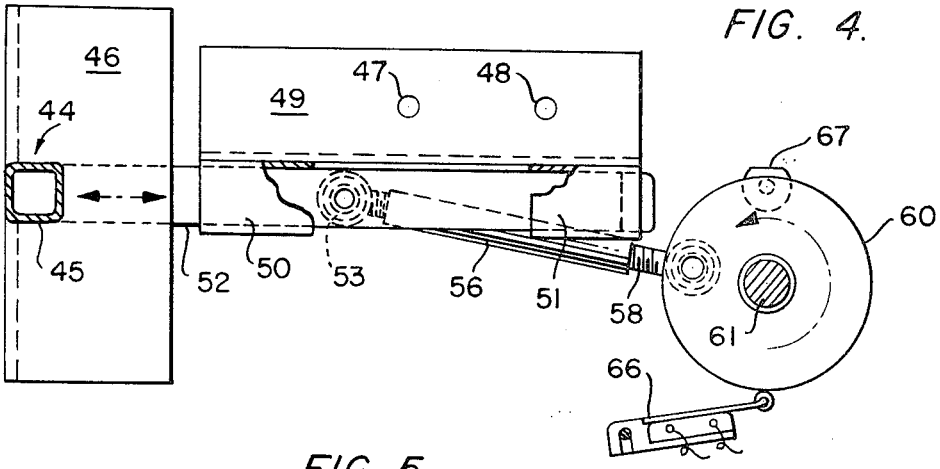
FIG. 4 is a section taken on lines 4—4 of FIG. 2, looking in the direction of the arrows.
Figure 5:
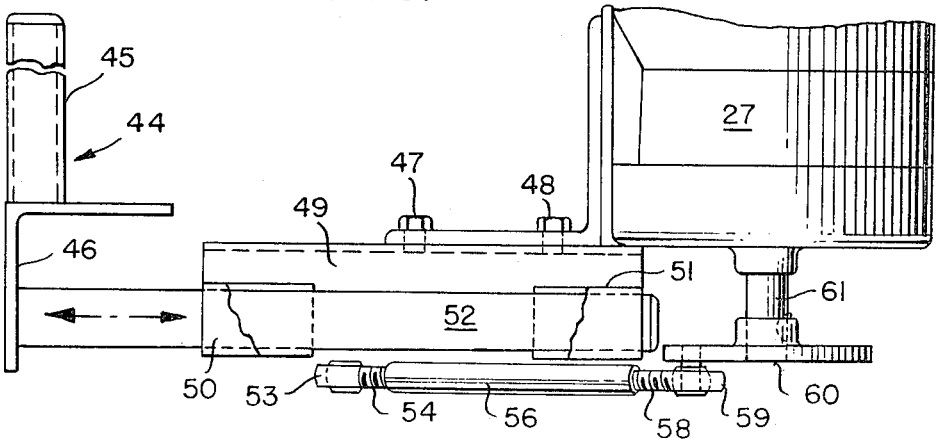
FIG. 5 is a top plan view of FIG. 4 of the drawings, with parts broken away, and FIGS. 6 to 11 inclusive show the sequence of operation of the bender and flattener of the present invention, the sequence beginning at FIG. 6 and continuing to FIG. 11.
Figure 6:
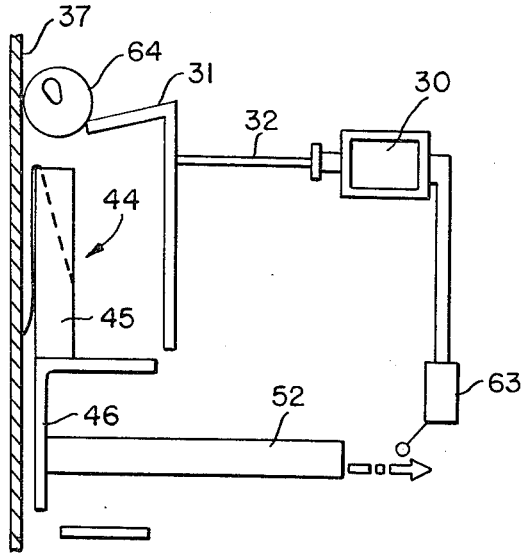
Figure 7:
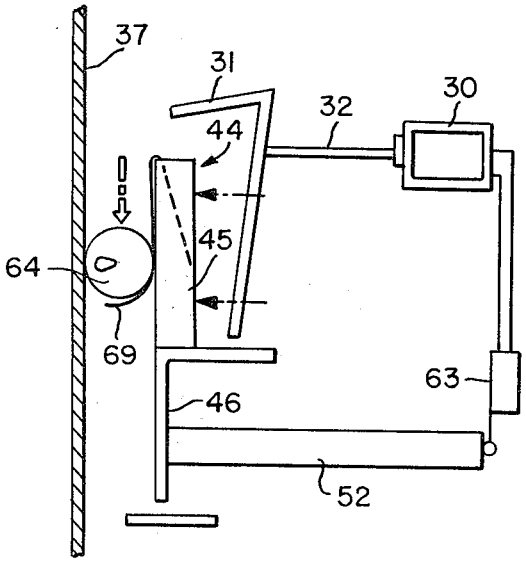
Figure 8:
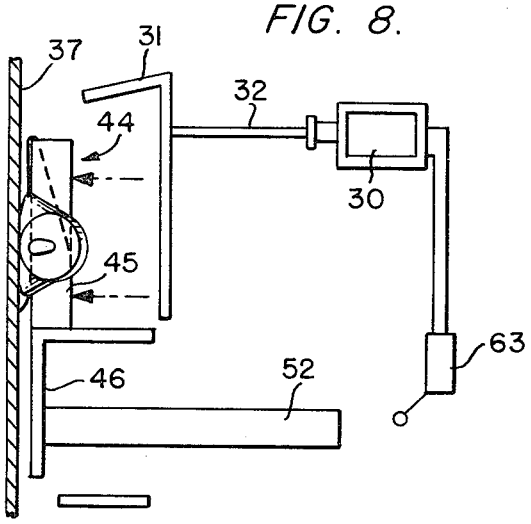
Figure 9:
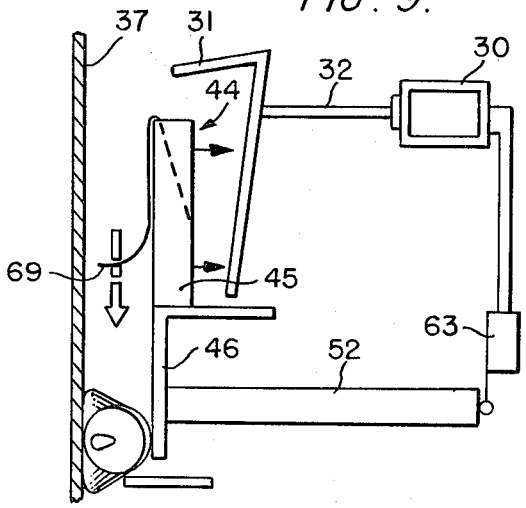
Figure 10:
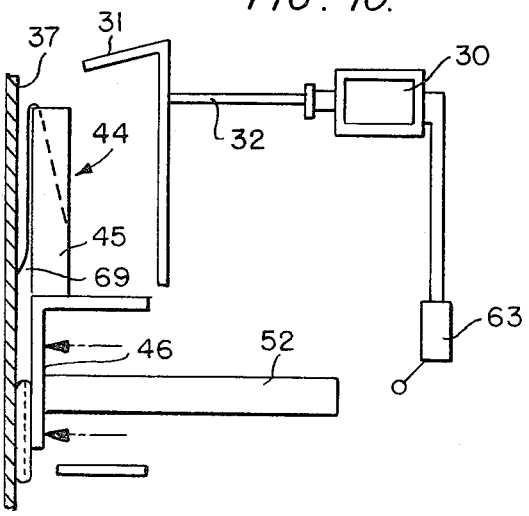
Figure 11:
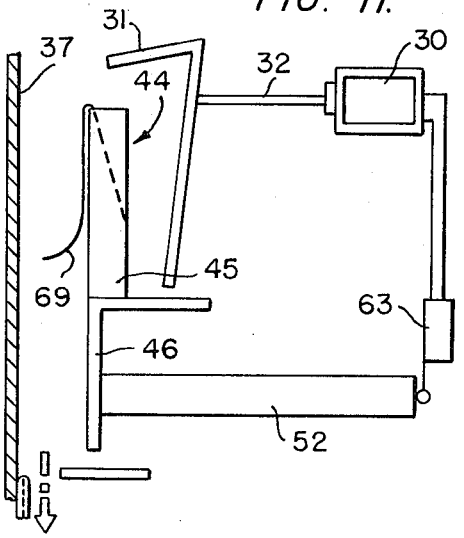

Secured to the U-shaped legs in any known manner as by bolts 47, 48 is a bracket 49 more clearly shown in FIGS. 4 and 5 of the drawings. Bracket 49 includes a pair of guide means 50, 51 of square configuration which are formed integral or otherwise secured to the bracket 49. Mounted for movement to and fro in the guides 50, 51 is a rod 52, also of square configuration and secured to rod 52 is a bearing 53 which is provided with an externally threaded bolt 54 which threads into the internally threaded section at one end of a connector rod 56 which is provided with a like internally threaded section at the other end of the connector rod 56. An externally threaded bolt member 58 is formed integral with a bearing 59 which is mounted for rotation on a wheel-like member 60 which is keyed or otherwise secured to the shaft 61 of motor 27. Rod 52 is welded or otherwise secured to the flattener 46 so that to and fro movement of rod 52 will impart a like to and fro movement of the flattener 46.

A master switch 62 incorporates a timer relay and the switch 62 is closed when a can 64 contacts a switch arm 65 which is located in the path of travel of the can. However, the master switch 62 will remain open unless the removable cover 17 has been positioned in the cabinet and the contacts 18 on the cover contact the switch arm 20. Thus, it will be seen that unless the removable cover is properly positioned in the cabinet, there will be no flow of electrical power to operate the flattener. This will serve as a safety feature for the flattener.

A counting mechanism 63 is also mounted on the rear wall 40 of the chamber 37 to thus count the number of cans flattened by the apparatus of the present invention. A limit switch 66, see FIG. 4, is mounted in any known manner within the cabinet and is adapted to contact a lobe 67 mounted for rotation on wheel 60 which is secured to the shaft 61 of motor 27.

Referring now more particularly to FIGS. 6 to 11 of the drawings, there is shown a leaf spring member 68 secured in any known manner to post 45. The spring extends into the path of descent of the can and is provided with a curved portion 69. The descending can will engage the curved portion 69 of the spring 68 to hold the can at that position of the flattener until such time as post 45 engages the can to bend the same.

Operation of the flattener is as follows:

With the removable cover 17 in proper position in the cabinet, a can is placed in the inclined portion of the cover plate and allowed to roll downwardly and contacts switch arm 65. The lobe 67 on wheel 60 will have been positioned on the wheel at a precise location thereon and when the limit switch 66 is actuated by contact with the aforesaid lobe, the solenoid 30 is also actuated to retract the gate 31, permitting a can to drop into the chamber 37. Immediately upon entry of the can in the upper portion of the chamber 37, and engaging switch arm 65, the motor 27 will cause the rod 52 and folder assembly 44 to travel towards the rear of the chamber 37 and engage the can midway thereof and to bend the same.

Following the bending of the can, the motor 27 will move the rod 52 and folder assembly to move rearwardly thus allowing the bent can to fall further down into the chamber 37. When the can approaches the bottom of the chamber 37, motor 27 in response to the limit switch and lobe on the wheel 60, will again cause the rod 52 and folder assembly 44 to travel towards the rear of the chamber whereupon the can will be contacted by the flattener 46 and flattened.

The cycle of operation set forth above will continue until there are no more cans to be flattened, whereupon by reason of the time relay with switch 62, the electrical power will be discontinued following a set period of time.

Although the invention has been herein shown and described in what is conceived to be the most practical and preferred embodiment, it is recognized that departure may be made therefrom within the scope of the invention, which is not to be limited to the illustrative details disclosed.

Having described my invention, what I claim as new and desire to secure Letters Patent is:

1. An apparatus for flattening cans comprising a cabinet, a can delivery chute extending vertically downwardly from the top wall of said cabinet, a switch extending in said chute, a motorized means within said cabinet for effecting a to and fro movement of a flattening assembly, a movable gate extending in said chute to thereby prevent a can from downward travel in said chute until said switch in said chute is contacted by a can to be flattened, said flattening assembly comprising a post member and a flattener member, said switch in said chute actuating said motorized means, a solenoid switch in said cabinet, said solenoid switch responsive to the opening and closing of said switch in said chute, a solenoid mounted in said cabinet to actuate said gate, a connector means extending between said solenoid and said gate to open said gate thereby permitting downward travel of said can in said chute, a timer associated with said motorized means whereby said post member engages said can at the upper portion of said chute to bend the same and again in timed relationship the can is caused to descend into the lower portion of said chute where the same is contacted with said flattener which is also caused to travel to and fro in said cabinet to effect a flattening of said can in said chute.

2. The structure recited in claim 1 wherein said movable gate is spring biased and overlies said chute and wherein said gate is opened in response to the actuation of said solenoid.

3. The structure recited in claim 1 wherein a safety switch is provided in said cabinet and wherein a removable cover must be in position in said cabinet before said motorized means can be energized.

4. The structure recited in claim 1 wherein said cabinet has mounted thereon a counting mechanism to count the number of flattened cans exiting from the outlet end of the cabinet.

5. The structure recited in claim 1 wherein a spring arm is secured to said post member to arrest the descent of said can into said chute.

* * * * *